US006354926B1

(12) United States Patent
Walsh

(10) Patent No.: US 6,354,926 B1
(45) Date of Patent: Mar. 12, 2002

(54) PARALLEL ALIGNMENT METHOD AND APPARATUS FOR CHEMICAL MECHANICAL POLISHING

(75) Inventor: Thomas Walsh, Templeton, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 09/038,875

(22) Filed: Mar. 11, 1998

Related U.S. Application Data

(63) Continuation-in-part of application No. 08/892,795, filed on Jul. 15, 1997, now Pat. No. 6,045,716.

(60) Provisional application No. 60/036,298, filed on Mar. 12, 1997.

(51) Int. Cl.[7] ..... B24B 5/00; B24B 5/08; B24B 5/313

(52) U.S. Cl. ..... 451/285; 451/247; 451/51; 451/256; 451/259; 451/287; 451/288; 451/332; 451/401

(58) Field of Search ..... 451/288, 51, 285, 451/287, 247, 256, 259, 401, 332

(56) References Cited

U.S. PATENT DOCUMENTS 5,681,215 A * 10/1997 Sherwood et al. ..... 451/388
5,738,574 A * 4/1998 Tolles et al. ..... 451/288
5,804,507 A * 9/1998 Perlov et al. ..... 438/692

* cited by examiner

*Primary Examiner*—Robert Dawson
*Assistant Examiner*—Jeffrey B. Robertson
(74) *Attorney, Agent, or Firm*—Martine & Penilla, LLP

(57) ABSTRACT

A parallel alignment device for chemical mechanical polishing using a plurality of carrier devices (123) rotatably coupled to a turret means. The apparatus (100) includes a turret and plurality of rotatable polishing surfaces (111) positioned around the turret. The apparatus also includes a plurality of carrier devices (123) rotatably coupled to the turret, where the carrier devices (123) are each adapted to hold a workpiece to be polished on at least one of the rotatable polishing surfaces. Each of the carrier devices is operably independently to each other during a process for chemical mechanical polishing.

21 Claims, 8 Drawing Sheets

PARALLEL ALIGNMENT METHOD AND APPARATUS FOR CHEMICAL MECHANICAL POLISHING

This application is a continuation-in-part of and claims the benefit of U.S. application Ser. No. 08/892,795, filed Jul. 15, 1997, 6,045,716 and claims the benefit of U.S. Provisional Application No. 60/036,298, filed Mar. 12, 1997, the disclosures of which are incorporated by reference.

BACKGROUND OF THE INVENTION

The present invention relates to the manufacture of integrated circuits. More particularly, the invention provides a technique including a method and an apparatus for chemical mechanical polishing using a device that maintains substantially parallel alignment between a surface of a film being polished and a rotating polishing surface, as well as other features. Among other benefits, parallel alignment tends to produce more uniformity in the film being processed and maintains film quality.

Chemical mechanical polishing or planarization ("CMP") is a technique of polishing materials including semiconductor substrates and films overlying such substrates, which provides a high degree of uniformity and planarity. The process is used to remove high elevation features on films created during the fabrication of a microelectronic circuitry on the substrate, or to remove a layer of film to reveal the circuitry buried underneath the film. In some cases, the process can even planarize semiconductor slices prior to the fabrication of microelectronic circuitry thereon.

A conventional chemical mechanical polishing process uses an apparatus having a single large polishing pad positioned on a platen, against which a substrate is positioned for polishing. A positioning member positions and biases the substrate to be polished against the polishing pad, which is rotating. A chemical slurry, which is likely to have abrasive materials, is maintained on the polishing pad to modify the polishing characteristics of the polishing pad and to enhance the polishing of the substrate or films.

Unfortunately, chemical mechanical polishing is not free from limitations in the manufacture of integrated circuits. For instance, CMP is extremely time consuming, which generally influences wafer throughput. Additionally, the polishing pad often accumulates residual by-products from the polishing operation or wears and deforms the polishing pad, which leads to degradation of the polishing efficiency for the polishing operation. Furthermore, the apparatus with the single polishing pad can only perform a single process such as dielectric layer polishing or tungsten film polishing, thereby requiring an additional apparatus to perform other processes. Moreover, conventional CMP of large substrate surfaces tends to be problematic, since it is often difficult to maintain parallel alignment between a substrate surface and a rotating polishing surface using conventional techniques. Accordingly, conventional chemical mechanical polishing has a variety of limitations.

From the above, it is seen that a technique for chemical mechanical polishing which is cost effective and efficient is often desirable.

SUMMARY OF THE INVENTION

According to the present invention, an improved technique for chemical mechanical polishing is provided. In particular, the technique uses an apparatus having a multi-head turret for providing chemical mechanical polishing using one of a plurality of polishing surfaces. In an exemplary embodiment, each of the carrier devices, which secures a workpiece to be processed, is coupled to a common turret by way of at least two fingers that are pivotable to secure each carrier device in parallel alignment to one of a plurality of the polishing surfaces. These two fingers that are pivotable absorb process non-uniformities to maintain parallel alignment between a surface of the workpiece and the polishing surfaces.

In a specific embodiment, the present invention provides an apparatus for chemical mechanical polishing using a plurality of carrier devices rotatably coupled to a turret means. The apparatus includes the turret means and a plurality of rotatable polishing surfaces (e.g., rotating polishing pad and platen) positioned around the turret means. The apparatus also includes a plurality of carrier devices and rotatably coupled to the turret, where the carrier devices are each adapted to hold a workpiece (e.g., a wafer, a semiconductor wafer, a patterned semiconductor wafer, a plate, hard drives, a display panel, a substrate, and magneto resistive read-write heads) to be polished on at least one of the rotatable polishing surfaces. Each of the carrier devices is operably independent to each other during a process for chemical mechanical polishing. Accordingly, each of the carrier devices can move freely in three dimensions, e.g., vertical, radial, and angular, i.e., rotational or tangential. In preferred embodiments, each of the carrier devices, which secures a workpiece, is coupled to a common turret by way of at least two fingers that secure each carrier device in parallel alignment to one of a plurality of the polishing surfaces. Parallel alignment is maintained over any substantial variations in processing conditions.

In an alternative embodiment, the present invention provides a method of processing a surface of a workpiece using, for example, an apparatus for chemical mechanical polishing. The method includes steps such as securing a workpiece onto a carrier device, where the film to be processed faces away from the carrier device. The method positions a surface of the workpiece against a rotatable polishing surface, which biases the face against the rotatable polishing surface. In a specific embodiment, the workpiece is rotating and the rotatable polishing surface is also rotating as the face is biased. The method also includes a step of maintaining a substantially planar or parallel configuration between the surface of the workpiece and the rotatable polishing surface. Such maintaining step occurs by at least two fingers or pivotable members operable coupled to the spindle of the carrier device. In operation, the two fingers are in a substantial parallel alignment position relative to each other, which keeps the spindle in a substantial normal position relative to the surface of the workpiece. Variations in a process that cause the spindle to move out of a normal position can be absorbed by the two fingers or pivotable members, which couple to the fingers by movable couplings. Parallel alignment is maintained over any substantial variations in processing conditions.

Benefits are achieved using the present invention. In particular, the multi-carrier design allows for higher wafer throughput over pre-existing techniques. Additionally, a variety of polishing processes (or recipes) can be performed using the present apparatus. Furthermore, each of the carriers can be adjusted in two or three dimensions independent of each other to achieve desired processing conditions. Additionally, the use of more than one finger coupled to a carrier device maintains a surface of a workpiece secured by the carrier device in substantially parallel alignment to a rotating polishing surface, which provides for a more uniform and accurate polishing process. These and other benefits are described throughout the present specification, and more particularly below.

The present invention achieves these benefits in the context of known process technology. However, a further understanding of the nature and advantages of the present invention may be realized by reference to the latter portions of the specification and attached drawings.

DETAILED DESCRIPTION OF SPECIFIC EMBODIMENTS

The present invention provides a technique including a method and an apparatus for performing CMP or the like. In preferred embodiments, the present invention provides a CMP apparatus having one or more carrier devices, which secures a workpiece. Each carrier device is coupled to a common turret by way of at least two fingers that secure each carrier device in parallel alignment to one of a plurality of the polishing surfaces. The combination of the fingers and the carrier device in a novel configuration provides for more uniform and accurate processing of, for example, a film or films on semiconductor wafers and the like.

Figure 1:
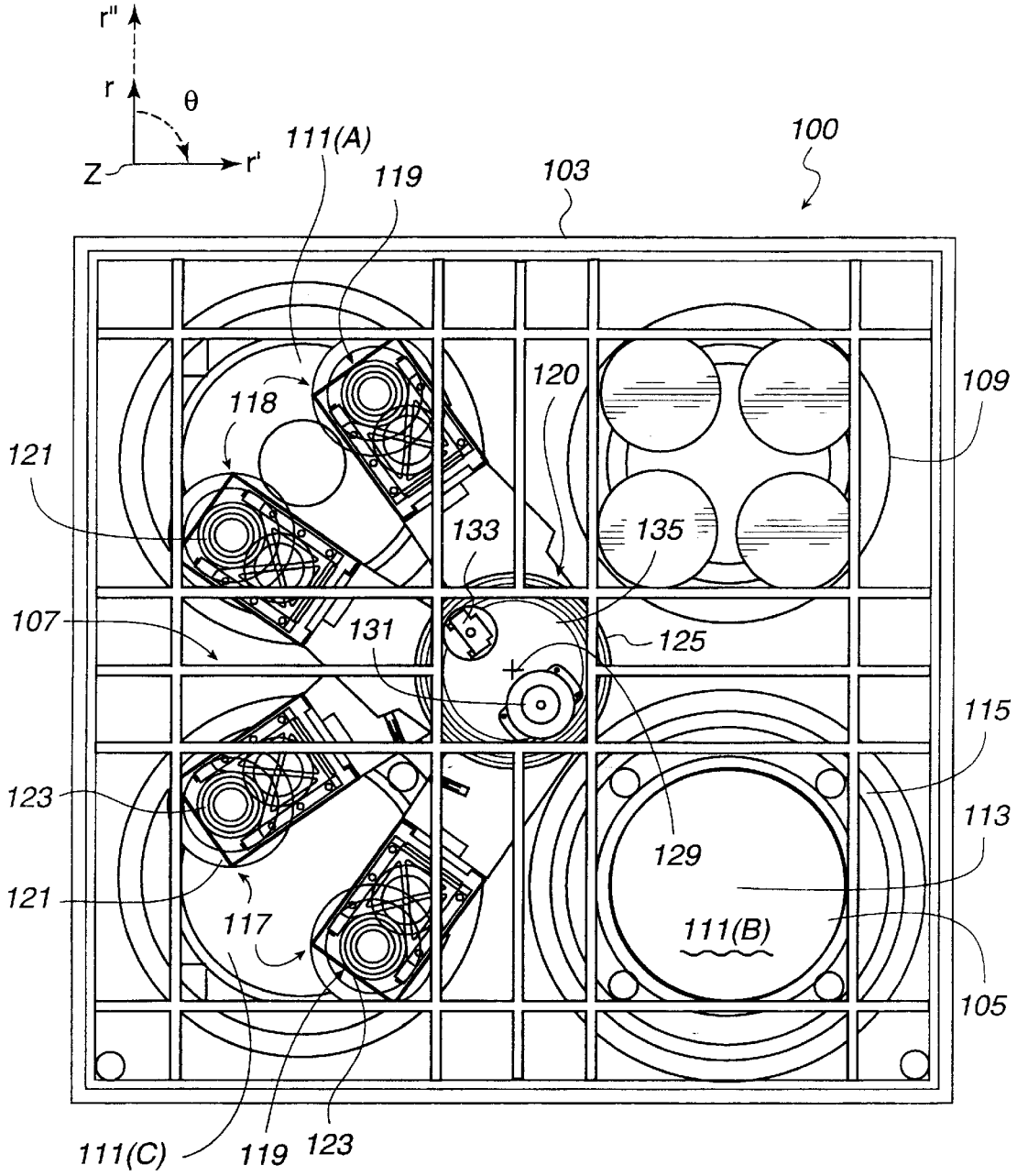
FIG. 1 is a simplified top-view diagram of a CMP apparatus according to the present invention.

FIG. 1 is a simplified top-view diagram of a CMP apparatus 100 according to the present invention. This diagram is merely an illustration and should not limit the scope of the claims herein. One of ordinary skill in the art would recognize other variations, alternatives, and modifications. To assist the reader in understanding the various features of the present invention, a spatial coordinate system is defined on the CMP apparatus. As shown, a vertical axis is defined by reference letter "z," which protrudes upwardly from and along the center region of the turret in an axial manner. A radial axis is defined by reference letter "r," which protrudes radially from the center region. Also shown is "r"," which defines movement away from the center region in a radial manner. An angle "θ," which ranges from a zero point at "r"and increases in a clock-wise manner to "r'," defines an angular or rotational or tangential coordinate, which is the final coordinate defined on the present CMP apparatus. This coordinate system will be referenced throughout the present specification and most particularly below.

The CMP apparatus 100 includes a variety of features for polishing a surface of a workpiece, e.g., semiconductor wafer, substrate, glass, or a film of material such as a conductive film or a dielectric film on a workpiece. The conductive film can be crystalline, polycrystalline, or amorphous, and include materials such as silicon, polysilicon, amorphous silicon, copper, tungsten, aluminum, titanium, platinum, silcides, polycides, alloys of these conductive materials, multilayered materials, and others. The dielectric layers include, among others, silicon dioxide, silicon nitride, doped and undoped oxides (e.g., borophosphosilicate ("BPSG") glass, phosphorus doped ("PSG") glass, fluorinated glass), tetraethylorthosilicate ("TEOS"), plastics, combinations thereof, and multilayered materials. The CMP apparatus 100 includes an enclosed housing 103, which generally encases a processing area having at least three sections, but can include a variety of others. These sections include a polishing area 105, handling means 107, and a wafer loading and unloading area 109, which are all described in more detail below.

The housing 103 is often made of removable panels disposed on a rigid frame structure. The removable panels enclose or encase the processing area, which tends to generate particulate contamination from the CMP process, including polishing pad and chemicals. The panels are removable for maintenance, safety reasons, and the like. Preferably, the panels are made of durable chemical resistant material, which can also have insulating qualities to reduce the amount of noise generated from the processing area. In most embodiments, the panels include outer regions made of a plastic material (e.g., polyvinylchloride, polypropylene) or a light weight fiberglass material that is disposed against an insulating material to reduce noise originating from the processing area. The panels generally form a "box-like" structure supported by a frame to encase the processing area. The frame is generally made of a strong and rigid material such as steel, stainless steel, and the like. Preferably, a chemical resistant coating (e.g., epoxy, chemical resistant paint, nickel plate, anodizing) is applied to the frame to protect the frame from chemicals in the processing area. The panels and doors also have exposed regions (e.g., clear glass, transparent plastic) for viewing or accessing the processing area. Additional regions of the housing include openings to access the control panel and the like. Of course, the type of housing used depends highly upon the application.

Figure 1A:
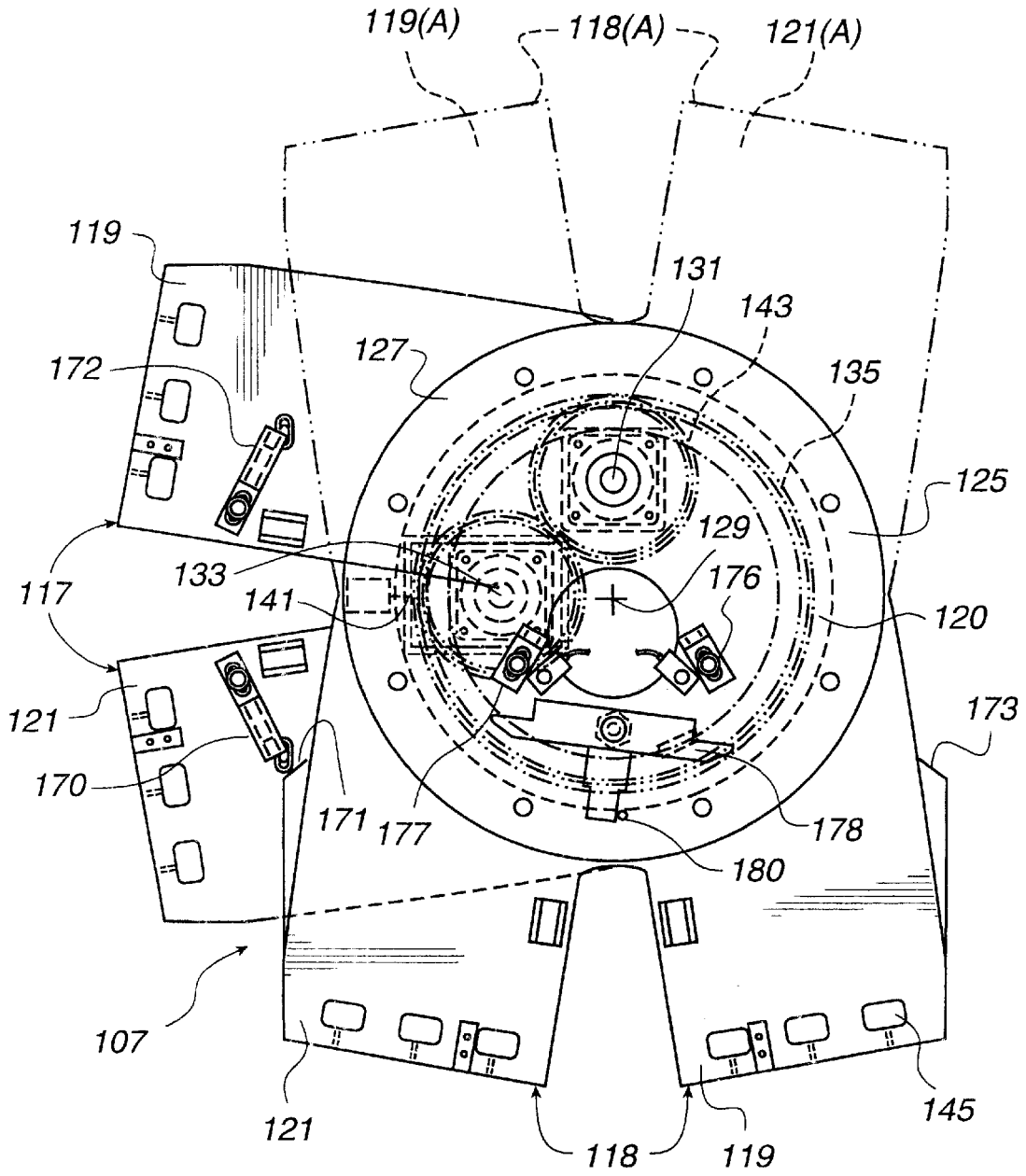
FIG. 1A is a more detailed top-view diagram of a turret assembly for the CMP apparatus of FIG. 1 according to the present invention.

The handling means 107 includes two leaf structures 117, 118 rotatably coupled to a turret, which are also shown in FIG. 1A. FIG. 1A uses similar reference numerals as FIG. 1 for easy reading. The two leaf structures protrude outwardly in a radial direction from the turret 120 to access regions overlying each of the three polishing surfaces 111. Each of the leaf structures 117, 118 include two fingers 119, 121 each of which includes a carrier device 123 attached to the end of the finger 119, 121. As shown, a preferred leaf structure includes at least two fingers 119, 121 coupled or connected directly to each other, but is not limited to these two fingers. For example, other embodiments use a single finger to support a single carrier. Alternatively, other embodiments use more than two fingers such as three fingers, four fingers, five fingers, or more fingers, each having at least one carrier device attached thereto. Of course, the number of fingers on each leaf structure used depends upon the application.

Each leaf structure rotates about the turret 120 in a relatively independent manner or a "scissor" like manner. In particular, leaf structure 117 rotates about the turret independently from leaf structure 118. To illustrate the concept of independent movement among the two leaf structures, they can be defined as leaf structure 118 and leaf structure 117, which rotate independently from each other, depending upon the process or application. For example, the leaf structure 118 can rotate about the turret to move the workpiece to polishing surface 111(A) or to polishing surface 111(B), as shown in FIG. 1, for example. Leaf structure 117 can also rotate from either polishing surface 111(C) or polishing surface 111(B) to move the workpiece to the load/unload station 109 or pick up a workpiece from the load/unload station. Leaf structure 117 can rotate about the turret to the load/unload station, as well as rotate to one or more of the polishing surface(s). In reference to FIG. 1A, for example, leaf structure 118 moves from a first position to a second position a shown by leaf structure 118(A), which includes fingers 119(A) and 121(A). Preferably, the leaf structures can not cross over each other to prevent a possibility of a collision between the two leaf structures. More preferably, each leaf structure can occupy any station, as long as another leaf structure is not occupying that station. Accordingly, each leaf structure has mechanical stops attached thereto to prevent collisions.

For instance, leaf structure 118 is aligned and is positioned with respect to leaf structure 117. As shown, leaf structure 118 includes stops 171, 173. Leaf structure 118 rotates in a counter-clockwise manner about center region 129 and relative to leaf structure 117 until stop 173 comes in contact with stop 172, which is defined on leaf structure 117. Alternatively, leaf structure 118 rotates in a clockwise manner about center region 129 and relative to leaf structure 117 until stop 171 comes in contact with stop 170, which is defined on leaf structure 117. Alternatively, leaf structure 118 rotates either in a clockwise or counter clockwise manner relative to leaf structure 117 until one of the stops collide with either stops 170 or 172. Leaf structure 118 also includes stops in the turret (or column) 120. For example, leaf structure 118 includes stops 176, 177, and 178, which allow leaf structure 118 to stop a selected regions relative to the turret, but allow for greater than a 360° rotation about the center region 129. Additionally, the combination of leaf structures may also include a stop pin 180, which limits the movement of these structures relative to the internal drive gears.

Each leaf structure, including fingers, is made of a substantially rigid material to support at least one carrier device 123, but can support others. The leaf structure is often made of a high grade steel, stainless steel, or the like, which has a sufficient thickness to support the carrier device and withstand pressure as required by a variety of processes. A chemical resistant material or coating can be applied to the leaf structure in preferred embodiments to withstand any aggressive chemicals, which may attack the leaf structure, from the processing area. Alternatively, the leaf structure can be made of an extremely high grade stainless steel (e.g., 303 or 304 stainless), which has been passivated (e.g., oxidized) to prevent chemical attack of the stainless steel material.

In operation, each leaf structure rotates horizontally about the turret along a fixed plane. Depending upon the application, rotation speed can vary. For example, each leaf structure can move in a constant, graduated, or stepped manner or rate around the turret and relative to each other. The rate is about 30 degrees per second ("DPS"). To transfer a workpiece from the load/unload station to a processing region overlying the polishing surfaces, for example, the leaf structure moves at least 30 DPS, excluding start-up or slow-down. During a polishing process, each leaf structure moves the carrier over the polishing surface at a rate ranging from about 0 DPS to about 10 DPS. These rates are often programmable. Additionally, the length of movement or "stroke" is also programmable. In most embodiments, each leaf structure accelerates to about 30 DPS in about ½ second, but can also accelerate at other rates. Additionally, each leaf structure can also operate in a slow speed mode to a fast speed mode, with other speeds in between.

Each leaf structure attaches to an annular shaped member 125, 127 which can freely rotate about a center region 129 of the turret. The annular shaped member is actually a bearing or bushing assembly and also supports the leaf structure about the turret in a rotatably coupled manner. The bearing or bushing assembly facilitates the rotational movement of the annular shaped member about the turret center region 129. Leaf structure 118 includes annular shaped region 127, and leaf structure 117 includes annular shaped region 125. An annular shaped gear or wheel drives each of the leaf structures. Preferably, an independent gear or wheel is used to drive each of the leaf structures in an independent manner.

As shown, gear wheel 131 drives leaf structure 118 and gear wheel 133 drives leaf structure 117. Gear wheel 131 includes an outer gear periphery 143 and gear wheel 133 includes an outer gear periphery 141. To move the annular shaped member, each gear wheel or outer gear can intermesh into a gear or "ring" gear assembly 135 defined on the inner periphery of the annular shaped member to drive the annular shaped member in a rotational manner about the center 129 of the turret. Alternatively, the annular shaped gear or wheel includes an outer surface that is relatively smooth, but has a large coefficient of friction relative to an inner periphery of the annular shaped member to drive the annular shaped member in a rotational manner about the center of the turret. This outer surface can be a "sticky" plastic material, rubber, or the like. As merely an example, the annular shaped gear or wheel is similar to "trucks" on a skateboard.

Each leaf structure includes a carrier device 123, which holds a workpiece to be polished on at least one of the polishing surfaces. A plurality of holes 145 are used to attach each carrier device to each leaf structure. Preferably, each carrier device is removable from the leaf structure by way of attachment means, e.g., bolts, screws, pins. By way of such attachment means, each carrier device can be removed and/or replaced for repair and preventive maintenance purposes. In some embodiments, one or more of the carrier devices is removed without interfering the operation of the other carrier devices.

The polishing area 105 has a plurality of polishing surfaces 111 (e.g., round wheels) disposed around handling means or turret 120. Each of the polishing surfaces 111 generally includes a polishing pad 113 defined overlying a rotatable platen assembly 115. The polishing pad 113 is a disk-shaped object having the polishing surface 111, which is rotatable about a fixed plane and axis. In preferred embodiments, the disk-shaped object is rotatable at a constant and varying speeds. For example, the disk-shaped object rotates at a speed greater than about 200 revolutions per minute ("RPM"), but less than about 2 RPM. Preferably, the speed of rotation ranges from about 10 RPM to about 150 RPM, but is often less than about 70 RPM. The disk-shaped object can accelerate to a speed of about 70 RPM in about 2 seconds or less, but can also be set at other acceleration rates. An electric motor often drives the disk-shaped object about a fixed plane axis in the z-direction. The motor can drive the disk-shaped object directly or through a drive train, e.g., gears, belts. Preferably, the electric motor is a brush less servo motor made by Sierracin or Kollmorgen, but can also be others.

The polishing pad 113 is often made of a tough "fabric-like" chemical resistant material, which is often embedded with an abrasive material. The polishing pad can be made from a material such as a poly-urethane, polyester, acrylic, acrylic ester copolymers, poly tetra-fluoroethylene, polypropylene, polyethylene, poly 4-methyl pentene, cellulose, cellulose esters, polyamides such as nylon and aramids, polyimides, polyimideamide, polysiloxane, copolymers, polycarbonates, epoxides, phenolic resins, and others. Of course, the type of material used depends upon the application. An example of this polishing surface made of a poly-urethane material is a product sold by Rodel called IC-1000, but can be others. In most embodiments, the abrasive is a plurality of particles, which are selected from a material such as a borosilicate glass, titanium dioxide, titanium nitride, aluminum oxide, aluminum trioxide, iron nitrate, cerium oxide, silicon dioxide (colloidal silica), silicon nitride, silicon carbide, graphite, diamond, and any mixtures thereof. The type of particle used depends highly upon the CMP application, e.g., tungsten, dielectric, oxide, nitride. The abrasive is often mixed in a solution (e.g., water, acid, base, organic solvent) to form a slurry, which can be applied to the polishing pad in a manual or automated manner.

Figure 2:
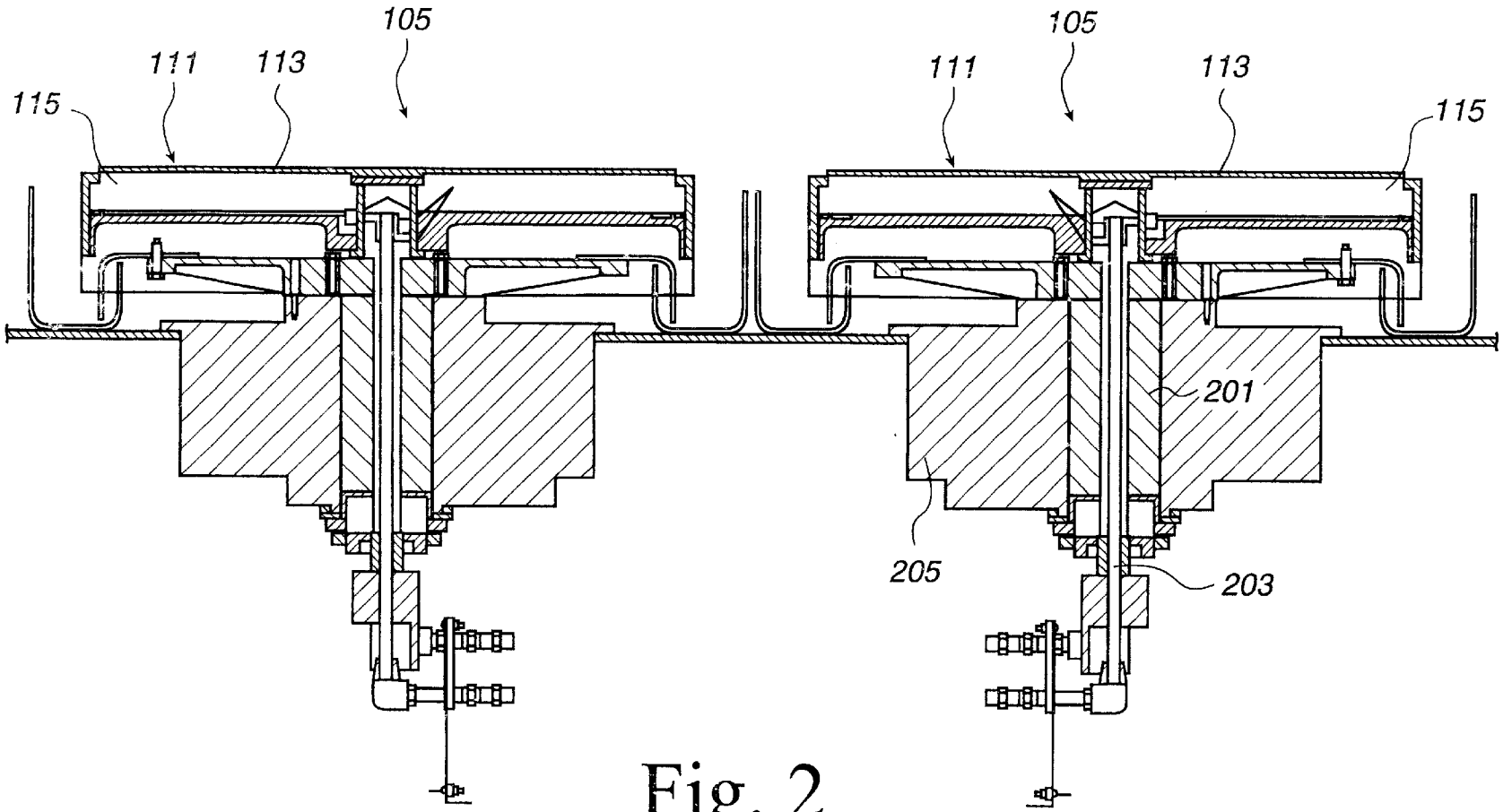
FIG. 2 is a simplified side-view diagram of polishing tables for the CMP apparatus of FIG. 1 according to the present invention.

A simplified side-view diagram of the polishing area 105 is shown by way of FIG. 2, for example. This diagram is merely an illustration and should not limit the scope of the claims herein. One of ordinary skill in the art would recognize other modifications, alternatives, and variations. As shown, FIG. 2 uses like reference numerals as the other Figs. for easy reading. The polishing area 105 includes polishing surface(s) 111, polishing pad(s) 113, and rotatable platen assembly 115. Each of the polishing pads includes an upper surface having the same or similar height relative to the z-axis. To rotate platen assembly 115, axle 203 drives the platen assembly by way of an attachment to a center region of the assembly. Axle 203 also inserts into annular region 201, which houses the axle. Axle 203 moves in or rotates in annular region 201 by way of force applied to the axle by a drive assembly 205, which is defined below the rotatable platen assembly. Axle 203 drives or rotates the platen assembly in a constant, varying, or stepped manner. For example, platen assembly rotates at a speed ranging from about 2 RPM to about 200 RPM. Preferably, rotation occurs at a speed greater than about 30 RPM during processing, but also can be others.

Figure 3:
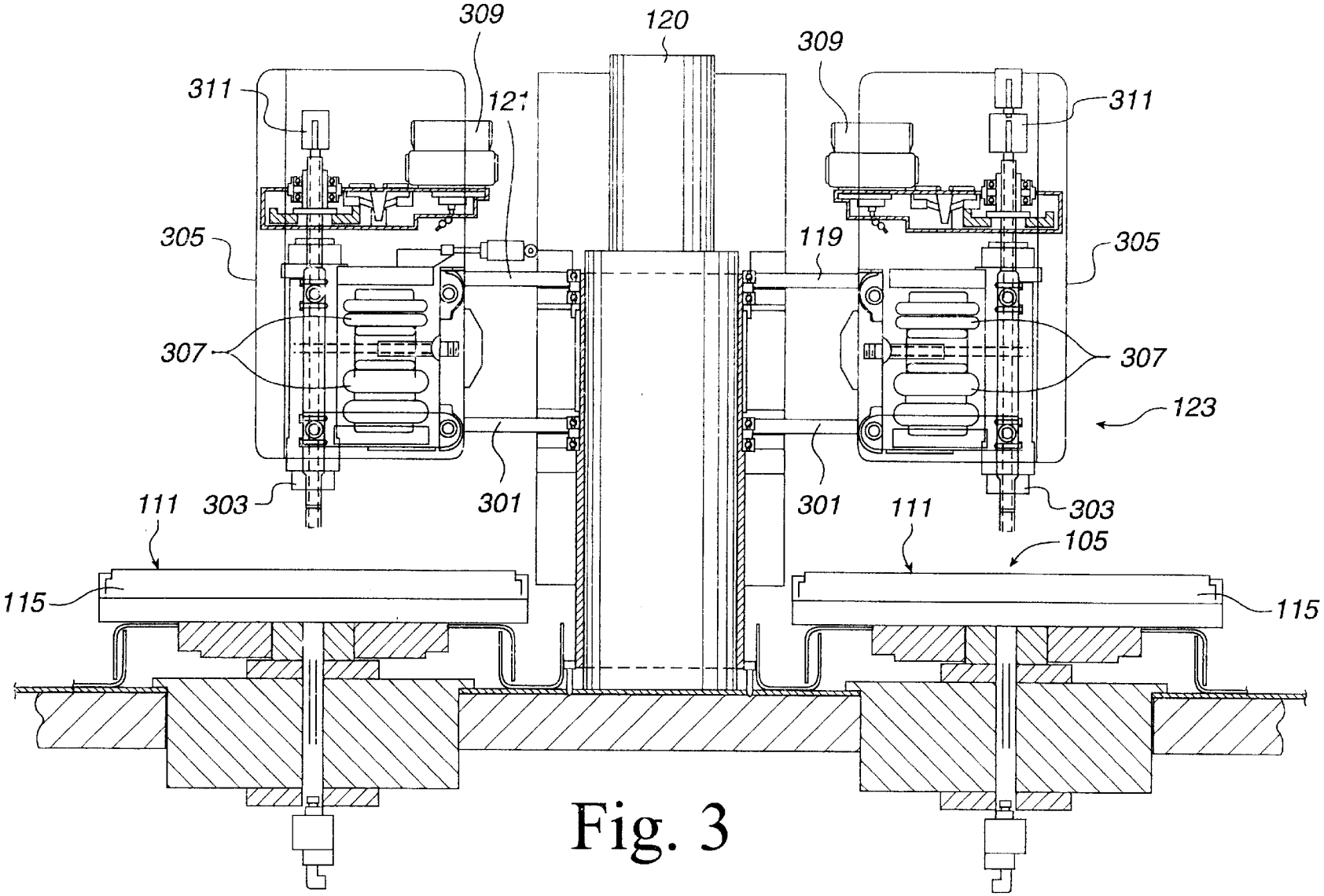
FIG. 3 is a simplified side-view diagram of carrier devices for the CMP apparatus of FIG. 1 according to the present invention.

In relation to the handling means, including the leaf structure(s), a simplified side view diagram of the polishing area is shown by FIG. 3. This diagram is merely an illustration and should not limit the scope of the claims herein. The diagram includes, among other features, the polishing area 105, and the polishing surfaces. As shown, each of the polishing surfaces 111 is disposed around the handling means, including the turret 120 and the leaf structure(s). Each leaf structure includes two fingers 119 and 121. These fingers were actually upper fingers. Additionally, each leaf structure includes lower fingers 301, which are directly below upper fingers 121. The leaf structure further includes lower fingers (not shown) directly below upper fingers 119. Between each pair of lower and upper finger is the carrier device 123. That is, each pair of fingers holds the carrier device in parallel alignment to the polishing surface.

Each carrier device 123 includes an actuator or bellows device 307 between the fingers for adjusting the vertical or z-location of a workpiece held by a workpiece carrier (not shown) relative to the polishing surfaces. The bellows device has a range of operation greater than about 3½ inches or preferably greater than about 4 inches, which is measured from an upper point along the z-axis and a lower point along the z-axis. Bellows device 307 also provides force in the z-direction to the backside surface of the workpiece held by a workpiece carrier. In a specific embodiment, the force ranges from about 0 pounds to about 850 pounds and can be others. This force provides a pressure of about 300 pounds and greater to, for example, an eight inch wafer, which is biased against the polishing surface.

The workpiece carrier is attached to the end of a rotatable spindle 303. Spindle 303 is defined in a z-direction in the carrier device and is held by at least the bellows device. To drive the spindle in a rotational manner, spindle 303 is coupled to a drive assembly 311, which is driven by an electric motor (e.g., servo motor) 309. An example of this electric motor is a product manufactured by Animatics or Infranor, but can be others. A housing 305 encloses the spindle 303 and bellows 307 to protect them from the environment.

Figure 3A:
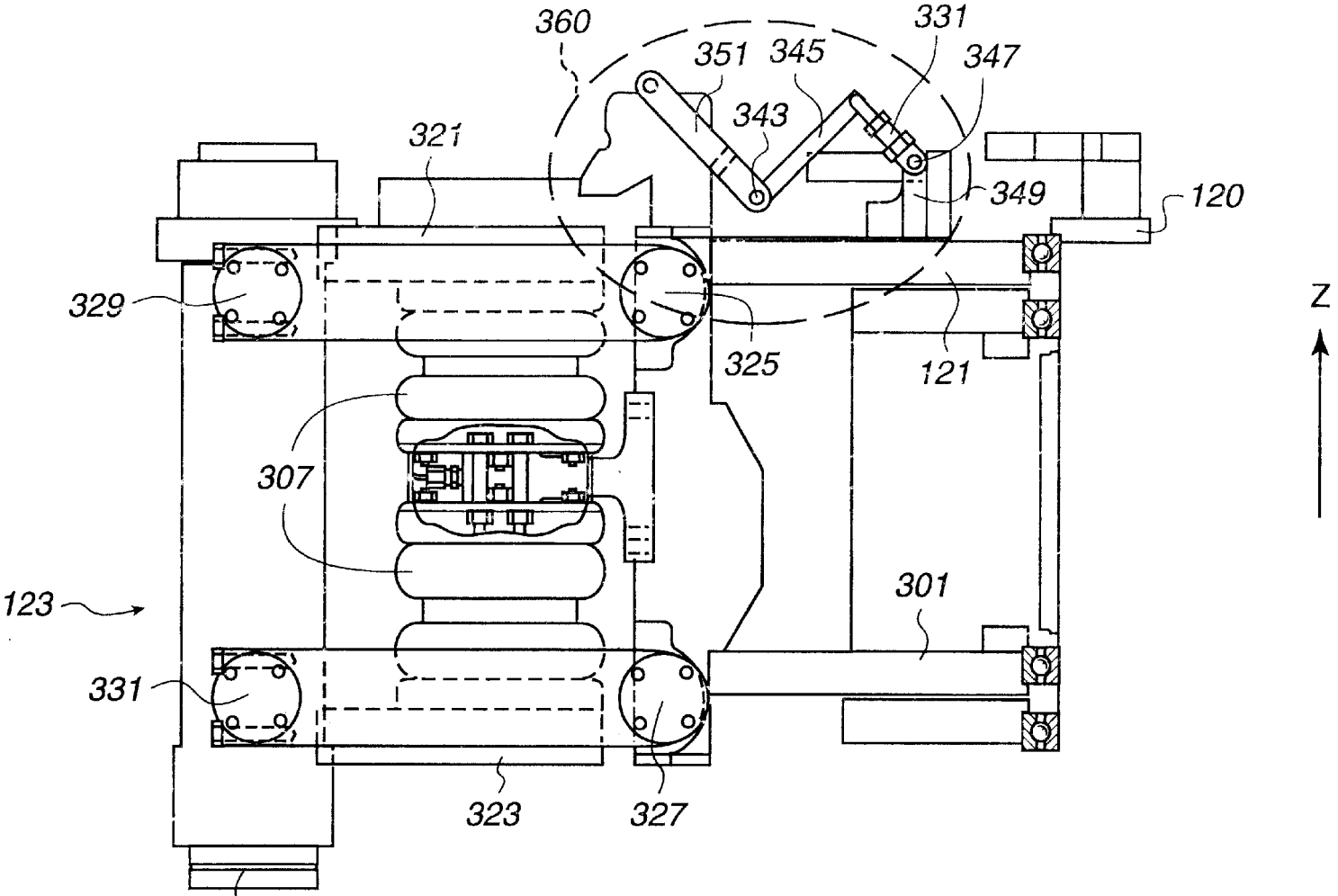
FIGS. 3A and 3B show simplified diagrams of carrier devices for the CMP apparatus of FIG. 1 according to the present invention.
Figure 3B:
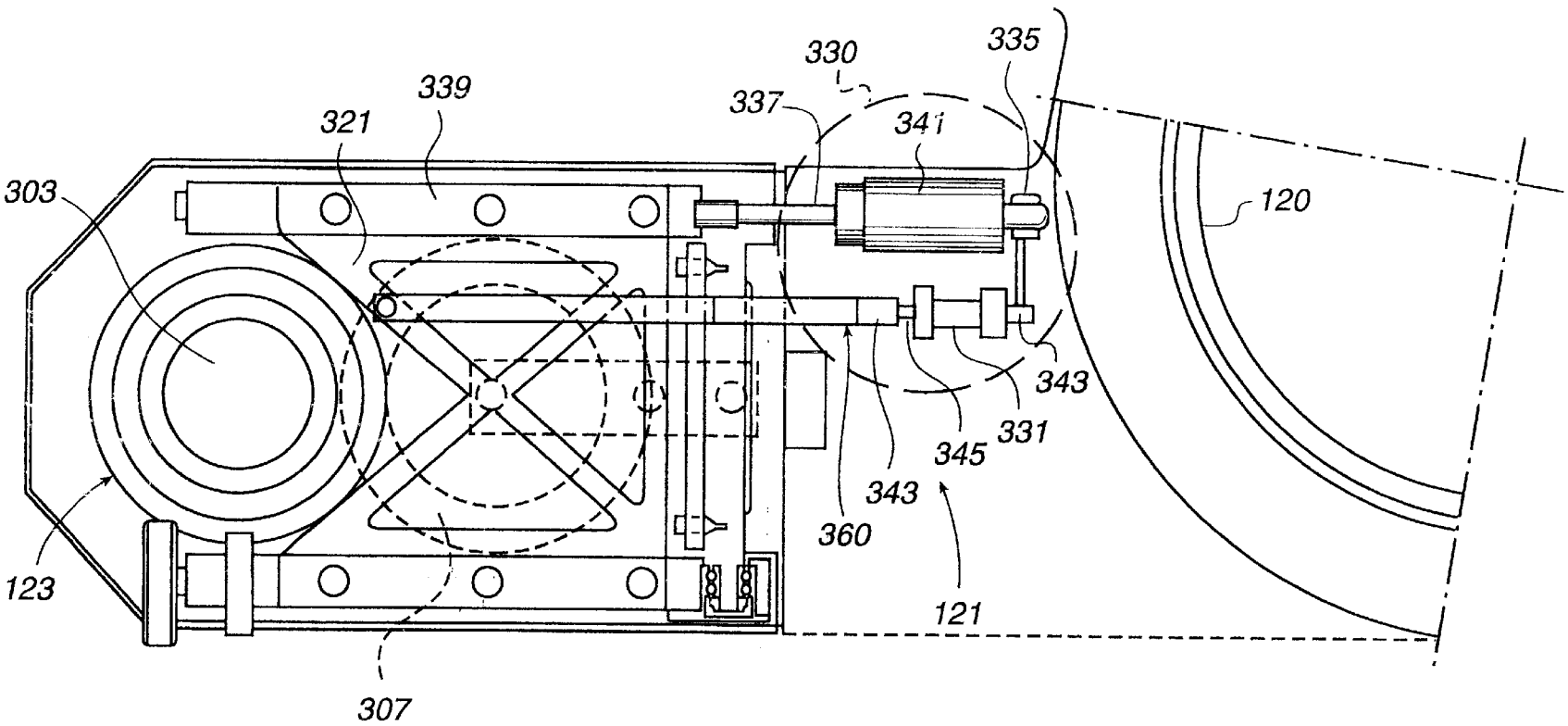

FIGS. 3A and 3B show simplified side-view and top-view diagrams, respectively, of handling means according to an embodiment of the present invention. These figures are merely illustrations and should not limit the scope of the claims herein. One of ordinary skill in the art would recognize numerous variations, alternatives, and modifications. Some like reference numerals are used in these figures as the previous figures for easy cross-referencing. Additional numerals are used to describe selected details of the handling means. As shown, the side-view diagram includes numerous features such as upper leaf structure 121 and lower leaf structure 301. One end of the leaf structures is operably coupled to turret 120. In most embodiments, the end coupled to the turret is relatively fixed to the turret and the distance between the ends of each leaf structure is fixed. In some embodiments, the two leaf structures can, however, move up and down along the z-axis by way of a driving device. Between each pair of lower and upper finger is the carrier device 123. That is, each pair of fingers holds the carrier device in parallel alignment to the polishing surface. Any up and down motion of the two leaf structures also moves the carrier device in a similar up and down manner.

The carrier device 123 includes an actuator or bellows device 307 between the fingers for adjusting the vertical or z-location of a workpiece held by a workpiece carrier (not shown) relative to the polishing surfaces. The bellows device has a range of operation greater than about 3½ inches or preferably greater than about 4 inches, which is measured from an upper point along the z-axis and a lower point along the z-axis. Bellows device 307 also provides force or pressure in the z-direction to the backside surface of the workpiece held by a workpiece carrier. In a specific embodiment, the pressure applied by the bellows device ranges from about 0 pounds to about 850 pounds and can be others. In a specific embodiment, the force provides a pressure of about 300 pounds and greater to, for example, an eight inch wafer, which is biased against the polishing surface.

In a specific embodiment, each leaf structure includes a pivotable member, which tends to maintain parallel alignment between a workpiece surface and a polishing surface. Leaf structure 121 includes, among other elements, a pivotable member 321, which is connected by coupling 325. Pivotable member 321 pivots about coupling 325. Leaf structure 301 includes, among other elements, a pivotable member 323, which is connected by coupling 327. Pivotable member 323 pivots about coupling 327. Bellows device 307 is disposed between the pivotable members 321, 323. Pivotable member 323 is connected to spindle 303 using coupling 331, and pivotable member 321 is connected to spindle 303 using coupling 329. Pivotable members work in tandem or pivot relative to the leaf structures about couplings 325 and 327. Pivotable members also work in tandem relative to spindle 303 about couplings 329 and 331.

Parallel alignment during processing of a workpiece occurs by way of a combination of pivotable members and couplings in connection to the spindle, among other elements. In particular, spindle 303 maintains a workpiece in parallel alignment to a polishing surface by way of a combination of movement from pivotable members about couplings 325 and 327 in some embodiments. In other embodiments, spindle 303 maintains a workpiece in parallel alignment to a polishing surface by way of a combination of movement from pivotable members about couplings 329 and 331. Still further, a combination of movement about each of the couplings maintains a parallel alignment of a workpiece surface relative to a polishing surface. Such parallel alignment between a rotating workpiece surface and a rotating polishing surface is important for providing efficient and uniform polishing of films and the like on substrates. To further understand the way these members work, it may be analogized that the combination of the pivotable members coupled to the spindle is similar in concept to "A-frame" support members which secure a spindle for a wheel on an automobile. Similar to the wheel on the automobile on a road, which should be in parallel alignment to the road to maintain traction, the rotating workpiece surface is maintained in parallel alignment to the rotating polishing surface to maintain uniform polishing characteristics.

Mechanical force or pressure is also placed on the carrier device to maintain force on upper leaf 121 or pivotable member 321 by way of actuator device 330, as shown in FIG. 3B. Actuator device 330 includes, among other elements, a pressure cylinder 331, which is coupled to a rigid or stationary location of upper leaf 121 by bracket or support 335, which can be secured to leaf 121 by welds, etc. Pressure cylinder 331 is coupled to the bracket by a pin or bolt, for example, which allows the pressure cylinder to move or pivot about a fixed axis. Movable end 337 of the actuator assembly couples to a top surface of pivotable member 321 using a bracket 339, which connects to or couples to the movable end 337 using a pin or bolt, which slides through an opening of the movable end 337. This movable end 337 can move or pivot about the pin or bolt during operation. Additionally, movable end 337 moves with pivotable member 321 and also adjusts or maintains a "pitch" of the pivotable member, thereby adjusting or maintaining the pitch of the assembly including the pivotable members, spindle, and bellows device.

In a specific embodiment, operation of the carrier device works in the following manner. Spindle 303 rotates a workpiece, which is disposed against a surface of a rotating polishing pad. Pressure on a backside of the workpiece is placed using the bellows device, which is coupled between the two pivotable members. To secure the relative position of the upper pivotable member, actuator device 330 applies force to the upper pivotable member using pressure cylinder, which is coupled to the upper surface of the upper pivotable member. Variations in the process can cause the relative position of the surface of the rotating workpiece with respect to the surface of the rotating polishing surface to become out of alignment, e.g., non-parallel. These variations are absorbed using the pivotable members, which are coupled to each other using couplings.

In an alternative embodiment where the carrier device moves (randomly and) upwardly outside of normal operating positions in the z-direction, the present invention includes an upper stop assembly 360 for the carrier device, as shown in the FIGS. 3A and 3B. The upper stop assembly includes a shock absorbing cylinder 341, which has a first end 347 that is pivotally attached using a pin, for example, to a portion of the upper leaf using a fixed mount 349 or bracket. The fixed mount can be secured to the upper leaf by welds or bolts. Shock absorbing cylinder 341 also includes a second end, which is pivotally coupled to a first member 345, which is pivotally coupled to a second member 351 using coupling 343, which can be a pin or bolt. The second member 351 can be pivotally coupled to the pivotable member 321. A combination of these members, which are pivotally coupled to each other, translate vertical movement of the spindle in the z-direction to shock absorbing cylinder. Shock absorbing cylinder "absorbs" shocks from, for example, a sudden movement of the spindle in the z-direction in embodiments where the spindle moves outside a normal operating position.

In alternative embodiments, spindle has a lower stop position, which can be forcibly made using an internal carrier device. The low stop position selectively adjusts the position of the carrier to a desired process location. In some embodiments, the low stop position is mechanically adjustable using simple tools or by hand. Alternatively, the low stop position is semi-automatically adjusted by way of computer software and the like. Of course, the adjustment of the lower stop depends upon the application.

The apparatus can be fully automatic or manual by way of at least the above handling means which is coupled to a controller (not shown) and which can maintain parallel alignment between a substrate surface and a polishing surface over substantial variations in processing. A method according to the present invention may be briefly outlined as follows:

(1) Provide plurality of workpieces to be processed in a workpiece carrier, e.g., boat or cassette;

(2) Transfer first workpiece (e.g., wafer having a film of tungsten, copper, aluminum, or dielectric material thereon) to an alignment station;

(3) Align first workpiece;

(4) Transfer first workpiece onto a load/unload station;

(5) Position first workpiece on load/unload station to a first carrier of a first leaf structure;

(6) Pick-up first workpiece using the first carrier;

(7) Position first workpiece for processing onto first processing surface, which is rotatable and maintain parallel alignment between the first workpiece and the first processing surface over process variations;

(8) Perform steps (1) to (6) for a second workpiece using a second carrier of a second leaf structure and then;

(9) Position second workpiece using second leaf structure for processing onto a second processing surface, which is rotatable and maintain parallel alignment between the first workpiece and the first processing surface over process variations;

(10) Transfer first or second workpiece to load/unload station;

(11) Transfer second or first workpiece to load/unload station;

(12) Transfer first workpiece into workpiece carrier using first leaf structure;

(13) Transfer second workpiece into workpiece carrier or cassette using second leaf structure;

(14) Perform remaining fabrication steps, as necessary.

The above sequence of steps are used to planarize a workpiece or planarize a film on a workpiece. These steps generally include the use of multiple carrier devices, which can each hold a workpiece for polishing, independently from each other. Accordingly, each carrier device can be adjusted independently to independently maintain processing conditions. Additionally, the multiple carrier devices can provide, for example, high throughput and workpiece processing. Parallel alignment between a workpiece surface and the polishing surface is maintained using a novel handling means. Again, these steps are merely examples and should not limit the scope of the claims herein. Details of the steps can be shown in a simplified flow diagram and the description below.

Figure 4:
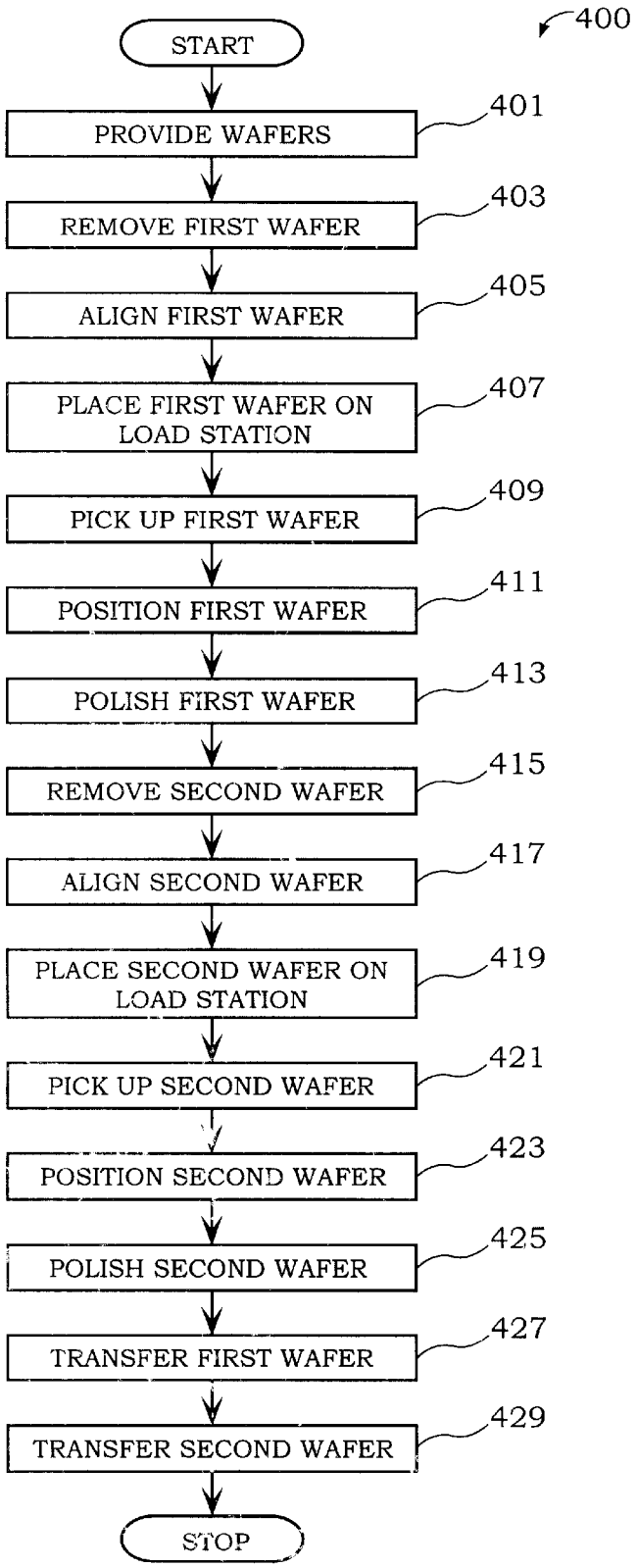
FIG. 4 is a simplified flow diagram of a method according to the present invention.

FIG. 4 is a simplified flow diagram of a method 400 according to the present invention. This method is merely an example and should not limit the scope of the claims herein. One of ordinary skill in the art would recognize other modifications, variations, and alternatives. The method generally describes a process of planarizing a tungsten film on a semiconductor wafer, for example.

The method 400 begins by providing (step 401) a plurality of wafers having a film of tungsten thereon to be processed in a carrier, e.g., wafer boat. A first wafer is removed (step 403) by way of a pick-up arm from the carrier and placed on an alignment station, which aligns (step 405) the wafer flat to a desired position. The first wafer is placed (step 407) on a load/unload station, which rotates to align the first wafer to a position to be picked up by a first carrier.

The first carrier rotates about the turret and positions its carrier head over the first wafer. The first carrier uses its bellows device to adjust the carrier head to a position directly overlying the wafer to pick up the wafer. Mechanical clamps secure the wafer to pick up (step 409) the wafer and vacuum secures the wafer to the carrier head. The bellows device adjusts the z-position of the wafer upwardly. The first carrier rotates about the turret to position (step 411) the wafer overlying a first polishing surface. The bellows device adjusts the z-position of the wafer downwardly such that the face of the wafer is biased against the polishing surface to perform the polishing operation (step 413). The polishing surface is generally rotated by way of a drive mechanism to enhance the polishing action. Additionally, a spindle rotates the wafer in a circular manner to further enhance polishing in some embodiments.

In a specific embodiment, a slurry mixture is applied directly to the polishing surface to enhance removal of tungsten material. This slurry mixture can be transferred to the polishing pad by way of a metering pump, which is coupled to a slurry source. The slurry is often a solution containing an abrasive particle and oxidizer, e.g., $H_2O_2$, $KIO_3$, ferric nitrate. The abrasive particle is often a borosilicate glass, titanium dioxide, titanium nitride, aluminum oxide, aluminum trioxide, iron nitrate, cerium oxide, silicon dioxide (colloidal silica), silicon nitride, silicon carbide, graphite, diamond, and any mixtures thereof. In a tungsten process, a preferred abrasive particle is aluminum oxide. This particle is mixed in a solution of deionized water and oxidizer or the like. Preferably, the solution is also acidic.

Independent to the operation of the first carrier, a second carrier undergoes the following processing steps to perform chemical mechanical planarization of a second wafer. A second wafer is removed (step 415) by way of a pick-up arm from the carrier and is placed on an alignment station, which aligns (step 417) the wafer flat to a desired position. The second wafer is placed (step 419) on a load/unload station, which rotates to align the second wafer to a position to be picked up by a second carrier.

The second carrier rotates about the turret and positions its carrier head over the second wafer. The second carrier uses its bellows to adjust the second carrier head to a position directly overlying the wafer to pick up the wafer. Mechanical clamps secure the wafer to pick up (step 421) the wafer, and vacuum secures the wafer to the carrier head. The bellows device adjusts the z-position of the wafer upwardly. The second carrier rotates about the turret to position (step 423) the wafer overlying a second polishing surface for polishing (step 425). The bellows device adjusts the z-position of the wafer downwardly such that the face of the wafer is biased against the polishing surface. The polishing surface is generally rotated by way of a drive mechanism to enhance the polishing action. Additionally, a spindle rotates the wafer in a circular manner to further enhance polishing, if desired.

After the polishing operation of the first wafer is completed, the first wafer is transferred (step 427) to the load/unload station. In particular, the bellows device adjusts the z-location of the wafer upwardly away from the polishing surface. The turret rotates the first carrier to a region overlying the load/unload station. The bellows device adjusts the z-location downwardly toward the load/unload station. The vacuum holding the wafer releases the wafer. The bellows device adjusts the carrier upwardly and the turret rotates the carrier away from the load/unload station so that the second wafer can be removed. Alternatively, the first carrier picks up another wafer to be processed and undergoes another polishing process.

The second wafer is also transferred (step 429) to the load/unload station after polishing is completed in an independent manner relative to the first wafer. In particular, the bellows device adjusts the z-location of the wafer upwardly away from the polishing surface. The turret rotates the second carrier to a region overlying the load/unload station. The bellows device adjusts the z-location downwardly toward the load/unload station. The vacuum holding the wafer releases the wafer. The bellows device adjusts the carrier upwardly and the turret rotates the carrier away from the load/unload station so that the first wafer can be removed, if necessary. Alternatively, the second carrier picks up another wafer to be processed and undergoes another polishing process. Of course, these sequences of steps are merely an illustration which should not limit the scope of the claims herein.

In an alternative embodiment, the present invention provides a method, which may be briefly outlined as follows:

(1) Provide plurality of workpieces to be processed in a workpiece carrier or boat;

(2) Transfer first workpiece (e.g., wafer having a film of tungsten, copper, aluminum, or dielectric material thereon) to an alignment station;

(3) Align first workpiece;

(4) Transfer first workpiece onto a load/unload station;

(5) Transfer second workpiece (e.g., wafer having a film of tungsten, copper, aluminum, or dielectric material thereon) to an alignment station;

(6) Align second workpiece;

(7) Transfer second workpiece onto a load/unload station;

(8) Position first and second workpieces on load/unload station to a first carrier and a second carrier, respectively, on a first leaf structure;

(9) Pick-up first and second workpieces using the first carrier and the second carrier;

(10) Position first and second workpieces for processing onto first processing surface, which is rotatable, and maintain parallel alignment between the second workpiece and the first polishing surface;

(11) Transfer polished first and second workpieces to load/unload station;

(12) Transfer first (or second) workpiece into workpiece carrier;

(13) Transfer second (or first) workpiece into workpiece carrier;

(14) Perform remaining fabrication steps, as necessary.

The above sequence of steps are used to planarize at least two workpieces or planarize a film on two workpieces using a single leaf structure. While the first and second workpieces are being polished, a second leaf structure can begin processing third and fourth workpieces simultaneously. For example, the method can process third and fourth workpieces using the second leaf structure performing steps (2)–(10) above, while the first leaf structure is polishing the first and second workpieces. These steps generally include the use of at least two carrier devices, which can each hold a workpiece for polishing, on a single leaf structure, which can be processed independently from another leaf structure. Accordingly, at least two carrier devices can be adjusted independently to independently maintain processing conditions. Additionally, the multiple carrier devices can provide, for example, high throughput of workpieces. Parallel alignment between the workpiece and the surface of the rotatable polishing surface is maintained using a novel handling means. Again, these steps are merely examples and should not limit the scope of the claims herein. Details of the steps can be shown in a simplified flow diagram and the description below.

Figure 5:
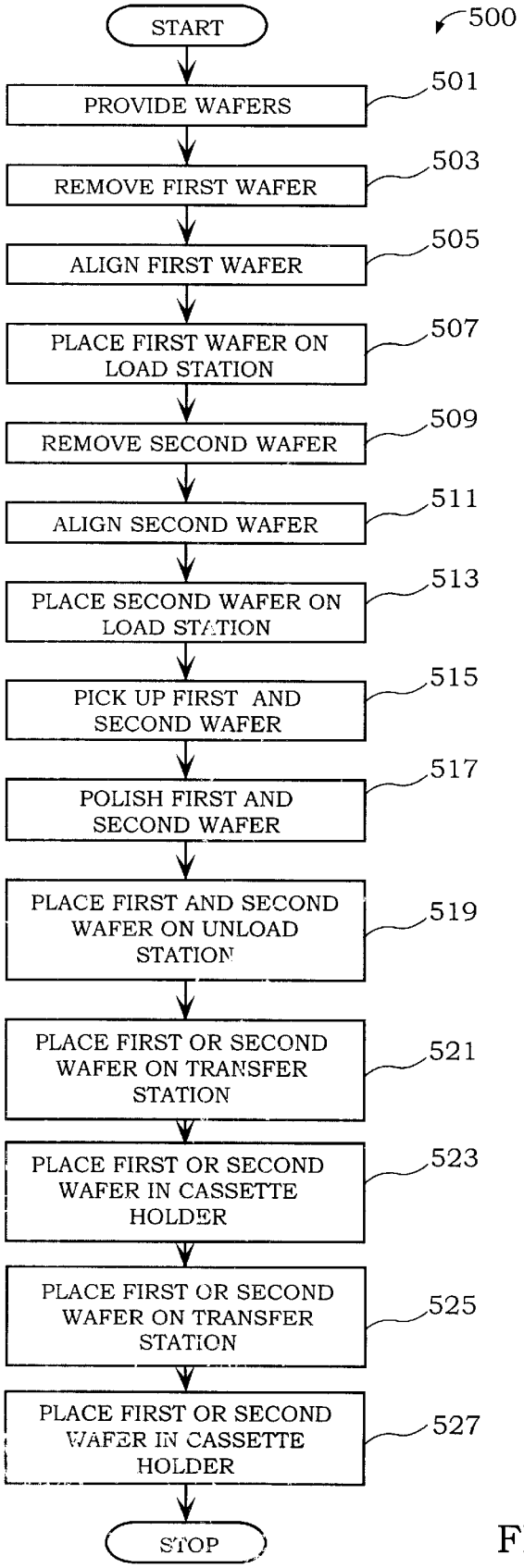
FIG. 5 is a simplified flow diagram of an alternative method according to the present invention.

FIG. 5 is a simplified flow diagram of a method 500 according to the present invention. This method is merely an example and should not limit the scope of the claims herein. One of ordinary skill in the art would recognize other modifications, variations, and alternatives. The method generally describes a process of planarizing a tungsten film on a semiconductor wafer, for example, by way of two carrier devices on a single leaf structure, such as the one described above, but can be others.

The method 500 begins by providing (step 501) a plurality of wafers having a film of tungsten thereon to be processed in a carrier, e.g., wafer boat. A first wafer is removed (step 503) by way of a pick-up arm from the carrier and placed on an alignment station, which aligns (step 505) the wafer flat to a desired position. The first wafer is placed (step 507) on a load/unload station, which rotates to align the first wafer to a position to be picked up by a first carrier on a first leaf structure. These steps are repeated for processing a second wafer. For example, a second wafer is removed (step 509) by way of a pick-up arm from the carrier and placed on an alignment station, which aligns (step 511) the wafer flat to a desired position. The second wafer is placed (step 513) on a load/unload station, which rotates to align the second wafer to a position to be picked up by a second carrier on the first leaf structure, which includes at least these two carrier devices.

The first leaf structure including the carriers rotates about the turret and positions its carrier heads over the first and the second wafers. The first carrier uses its bellows device to adjust the carrier head to a position directly overlying the first wafer to pick up the wafer. Mechanical clamps secure the first wafer to pick up (step 515) the first wafer and vacuum secures the wafer to the carrier head. The bellows device adjusts the z-position of the first wafer upwardly. Similarly, the second carrier head uses its bellows device to adjust the carrier head to a position directly overlying the second wafer to pick up the second wafer. Mechanical clamps secure the second wafer to pick up (step 515) the wafer and vacuum secures the wafer to the carrier head. The bellows device adjusts the z-position of the second wafer upwardly.

The first leaf structure including the carriers rotates about the turret to position the wafers overlying a first polishing surface. The bellows devices adjust the z-positions of the wafers downwardly such that the faces of the wafers are biased against the polishing surface to perform the polishing operations (step 517). The polishing surface is generally rotated by way of a drive mechanism to enhance the polishing action. Additionally, a spindle rotates each of the wafers in a circular manner to further enhance polishing in some embodiments.

In a specific embodiment, a slurry mixture is applied directly to the polishing surface to enhance removal of tungsten material. This slurry mixture can be transferred to the polishing pad by way of a metering pump, which is coupled to a slurry source. The slurry is often a solution containing an abrasive particle and oxidizer, e.g., $H_2O_2$, $KIO_3$, ferric nitrate. The abrasive particle is often a borosilicate glass, titanium dioxide, titanium nitride, aluminum oxide, aluminum trioxide, iron nitrate, cerium oxide, silicon dioxide (colloidal silica), silicon nitride, silicon carbide, graphite, diamond, and any mixtures thereof. In a tungsten process, a preferred abrasive particle is aluminum oxide. This particle is mixed in a solution of deionized water and oxidizer or the like. Preferably, the solution is also acidic.

After the polishing operations of the first and second wafers are completed, the first and second wafers are transferred (step 519) to the load/unload station. In particular, the bellows devices adjust the z-locations of the wafers upwardly away from the polishing surface. The turret rotates the first leaf structure including the carriers to a region overlying the load/unload station. The bellows devices adjust the z-locations downwardly toward the load/unload station. Vacuum holding the wafers release the wafers. The bellows devices adjust the carriers upwardly again and the turret rotates the carriers away from the load/unload station. Next, the first or second wafer is placed on a transfer station (step 521).

Each wafer is then placed or transferred into a cassette holder (step 523). For example, the first wafer is picked up and placed in the cassette holder. The second wafer is then picked up and placed in the cassette holder. Alternatively, the second wafer is picked up and placed in the cassette holder. The first wafer is then picked up and placed in the cassette holder. As noted above, a second leaf structure coupled to the turret can pick up third and fourth wafers while the first and second wafers are being processed. The use of the first and second leaf structures including at least four carrier devices allows for parallel processing of at least two or four wafers at the same time. Subsequently, the first or second wafer is placed on the transfer station (step 525), which is then followed by placing the first or second wafer in cassette holder (step 527). Of course, these sequences of steps are merely illustrations and should not limit the scope of the claims herein.

Although the above description is described generally in terms of polishing a tungsten film on a wafer, it would be easily recognized that the invention has a broader range of applicability. For example, the invention can also be applied to polishing surfaces of optical materials, substrates, glass, and other films on wafers. Additionally, the above method can be used for planarizing dielectric materials such as, for example, silicon dioxide, doped and undoped oxides, and other materials. Of course, the type of workpiece used depends highly upon the application.

In the above methods for polishing workpieces, parallel alignment between the workpiece surface and the polishing surface is maintained over process variations. In particular, parallel alignment during processing of a workpiece occurs by way of a combination of pivotable members and couplings in connection to the spindle, among other elements, such as those noted above, as well as others. As merely an example, a spindle such as the one described maintains a workpiece in parallel alignment to a polishing surface by way of a combination of movement from pivotable members about couplings in some embodiments. In other embodiments, spindle maintains a workpiece in parallel alignment to a polishing surface by way of a combination of movement from pivotable members about couplings. Still further, a combination of movement about each of the couplings maintain a parallel alignment of a workpiece surface relative to a polishing surface. Such parallel alignment between a rotating workpiece surface and a rotating polishing surface is important for providing efficient and uniform polishing of films and the like on substrates. To further understand the way these members work, it may be analogized that the combination of the pivotable members coupled to the spindle is similar in concept to "A-frame" support members which secure a spindle for a wheel on an automobile. Similar to the wheel on the automobile on a road, which should be in parallel alignment to the road to maintain traction, the rotating workpiece surface is maintained in parallel alignment to the rotating polishing surface to maintain uniform polishing characteristics. Of course, one of ordinary skill in the art would recognize other variations, modifications, and alternatives, which can be combined with any of the above embodiments, as well as others.

While the above is a full description of the specific embodiments, various modifications, alternative constructions and equivalents may be used. For example, while the description above is in terms of a multi-carrier design using a single turret, it would be possible to implement the present invention with multiple turrets and even more carriers. Therefore, the above description and illustrations should not be taken as limiting the scope of the present invention which is defined by the appended claims.

What is claimed is:

1. Apparatus for chemical mechanical polishing, said apparatus comprising:

a turret;

a plurality of rotatable polishing surfaces positioned around said turret;

a plurality of carrier devices rotatably coupled to said turret, each of said carrier devices being adapted to hold a workpiece to be polished on at least one of said rotatable polishing surfaces;

wherein each of said carrier devices comprises a spindle that is pivotally coupled to said turret by a lower finger and an upper finger, each of said carrier devices is positioned between said lower finger and said upper finger and said spindle is pivotably coupled to said turret to position said workpiece in parallel alignment with one of said rotatable polishing surfaces during a process.

2. Apparatus of claim 1 wherein each of said carrier devices includes an actuator to adjust said carrier device in a z-direction.

3. Apparatus of claim 1 wherein each of said rotatable polishing surface includes a polishing pad attached to a rotatable platen.

4. Apparatus of claim 1 wherein each of said carrier devices is rotatably coupled to said turret along a common axis.

5. Apparatus of claim 1 wherein each of said carrier device is rotatably coupled to said turret along a seperate axis.

6. Apparatus of claim 1 wherein each of said upper finger and said lower finger includes a bellows device between said upper finger and said lower finger.

7. Apparatus of claim 6 wherein said bellows device adjusts a vertical location of said workpiece held by said carrier device.

8. Apparatus of claim 6 wherein bellows device provides force in a vertical direction to a backside surface of said workpiece held by said carrier device.

9. Apparatus of claim 8 wherein said force ranges in pressure from about 0 pounds to about 850 pounds.

10. Apparatus of claim 7 wherein said turret comprises at least two of said leaf structures independently rotatably coupled to said turret, each of said leaf structures comprising at least one of said carrier devices.

11. Apparatus of claim 1 wherein said plurality of rotatable polishing surfaces include three rotatable polishing surfaces.

12. Apparatus of claim 1 further comprising a load/unload station positioned around said turret.

13. Apparatus of claim 1 wherein said workpiece is selected from a group comprising a wafer, a semiconductor wafer, a patterned semiconductor wafer, a plate, and a display panel.

14. Apparatus for chemical mechanical polishing, said apparatus comprising:

a turret;

a plurality of rotatable polishing surfaces positioned around said turret;

a plurality of carrier devices rotatably coupled to said turret, each of said carrier devices being configured to support a workpiece to be polished on at least one of said rotatable polishing surfaces, wherein each of said carrier devices comprises a spindle that is pivotally coupled to said turret by a lower finger and an upper finger to position said workpiece in parallel alignment with one of said rotatable polishing surfaces.

15. Apparatus of claim 14 wherein each of said carrier devices includes an actuator to adjust said carrier device in a direction perpendicular to said rotatable polishing surfaces.

16. Apparatus of claim 14 wherein each of said carrier devices is rotatably coupled to said turret along a common axis.

17. Apparatus of claim 14 further comprising a load/unload station positioned around said turret.

18. Apparatus for chemical mechanical polishing, said apparatus comprising:

a turret;

a plurality of rotatable polishing surfaces positioned around said turret;

a plurality of carrier devices each rotatably coupled to said turret by a lower finger and an upper finger, each of said carrier devices being configured to support a workpiece to be polished on at least one of said rotatable polishing surfaces; and means for coupling each of said carrier devices with said lower finger and said upper finger for said carrier device to position said workpiece in parallel alignment with one of said rotatable polishing surfaces.

19. Apparatus of claim 18 further comprising means for adjusting said carrier devices in a direction perpendicular to said rotatable polishing surfaces.

20. Apparatus of claim 18 further comprising means for adjusting said workpiece relative to said carrier device in a direction perpendicular to said at least one rotatable polishing surface.

21. Apparatus for chemical mechanical polishing, said apparatus comprising:

a turret;

a plurality of rotatable polishing surfaces positioned around said turret;

a plurality of carrier devices rotatably coupled to said turret, each of said carrier devices being configured to support a workpiece to be polished on at least one of said rotatable polishing surfaces, wherein each of said carrier devices comprises a spindle that is pivotally coupled to said turret by a lower finger and an upper finger to position said workpiece in parallel alignment with one of said rotatable polishing surfaces, said spindle being perpendicular to said rotatable polishing surface which is in parallel alignment with said workpiece.

* * * * *